US005186389A

United States Patent [19]

Shibano

[11] Patent Number: 5,186,389

[45] Date of Patent: Feb. 16, 1993

[54] SPRAY TUBE ULTRASONIC WASHING APPARATUS

[75] Inventor: Yoshihide Shibano, Aikoh, Japan

[73] Assignee: S & C Co.,Ltd., Kanagawa, Japan

[21] Appl. No.: 902,497

[22] Filed: Jun. 23, 1992

Related U.S. Application Data

[63] Continuation of Ser. No. 781,688, Oct. 25, 1991, abandoned, which is a continuation of Ser. No. 563,756, Aug. 7, 1990, abandoned.

[30] Foreign Application Priority Data

Apr. 3, 1990 [JP] Japan ..... 2-88560

[51] Int. Cl.[5] ..... B05B 17/06; B08B 3/02

[52] U.S. Cl. ..... 239/102.2; 239/290

[58] Field of Search ..... 239/102.2, 290

[56] References Cited

U.S. PATENT DOCUMENTS 3,528,704 9/1970 Johnson, Jr. ..... 239/499

3,807,632 4/1974 Johnson, Jr. ..... 239/290

4,834,124 5/1989 Honda ..... 239/102.2

*Primary Examiner*—Andres Kashnikow

*Assistant Examiner*—Lesley D. Morris

*Attorney, Agent, or Firm*—Cushman, Darby & Cushman

[57] ABSTRACT

Disclosed is a spray type ultrasonic washing apparatus using a coaxial nozzle structure which is composed of inner and outer hollow frustums for supplying deaerated washing liquid in the annular passage delimited by the outer and inner frustums and supplying nondeaerated washing liquid in the inner frustum, thus permitting deaerated washing liquid to be enclosed by nondeaerated washing liquid in spraying against work to be washed, thereby isolating deaerated washing liquid from the surrounding atmosphere to prevent invasion of air into the deaerated washing liquid. Thus, cavitation can be formed effectively in the deaerated washing liquid, and washing can be performed at an increased efficiency.

5 Claims, 2 Drawing Sheets

SPRAY TUBE ULTRASONIC WASHING APPARATUS

This is a continuation of application Ser. No. 07/781,688, filed on Oct. 25, 1991, now abandoned, which was a continuation of application Ser. No. 07/563,756, filed on Aug. 7, 1990, now abandoned.

BACKGROUND OF THE INVENTION

1. Field of the Invention

The present invention relates to a spray type ultrasonic washing apparatus, and more particularly to such ultrasonic washing apparatus using deaerated degassed washing liquid and keeping it in good deaerated condition on the way to work to be washed.

2. Description of the Prior Art

Ultrasonic washing apparatuses are widely used in washing work surfaces, deflashing work surfaces, etc.

Cavitation has been hitherto supposed to be easily formed in ultrasonic medium which is abundant in air bubbles.

The experiments performed by the inventor, however, revealed that to the contrary, cavitation can be easily formed in deaerated medium. This is because air bubbles in medium absorb energy of cavitation, thereby suppressing formation of cavitation. In contrast, when ultrasonic radiation is radiated in deaerated medium, a drastic pressure decrease will be caused under a certain condition, and when the deaerated medium pressure is lowered below saturated vapor pressure, the medium will be evaporated to form air bubbles, which will rapidly expand to form cavities. Then, they will be compressed to cause very high pressure, thereby expediting formation of cavitation.

For this reason use is made of deaerated medium in ultrasonic washing, and deaerated medium in which cavitation is formed, is sprayed against work to be washed.

This ultrasonic washing has the effect of reducing the time involved for washing works because deaerated medium permits effective formation of cavitation. Use of deaerated medium in the form of spray, however, permits invasion of air into the deaerated medium on the way to works to be washed. As a result the medium cannot remain deaerated, and the washing effect decreases with the decrease of cavitation.

SUMMARY OF THE INVENTION

One object of the present invention is to provide an ultrasonic washing apparatus which is capable of spraying deaerated supersonic medium against work to be washed without permitting invasion of surrounding air into the deaerated supersonic medium travelling on the way to the work, thereby assuring that no cavitation is suppressed.

To attain this object a spray type ultrasonic washing apparatus in which ultrasonic radiation is radiated in washing liquid to be sprayed against the surface of work, thereby causing cavitation in the washing liquid to improve the washing efficiency along with the spraying effect, is improved according to the present invention in that it comprises: a vibrating element to produce ultrasonic radiation; and a nozzle assembly positioned ahead of said vibrating element, said nozzle assembly being composed of an inner nozzle to define a passage through which deaerated washing liquid is made to flow, and an outer nozzle surrounding said inner nozzle to define an annular passage through which nondeaerated or gassed washing liquid is made to flow, thereby permitting nondeaerated washing liquid to envelope deaerated washing liquid, thus keeping deaerated washing liquid in such a good deaerated condition on the way to said work that no cavitation may be suppressed.

With this arrangement the deaerated medium ejecting from the inner nozzle will be enclosed with nondeaerated medium ejecting from the annular space between the outer and inner nozzles.

Other subjects and advantages of the present invention will be understood from the following description of a spray type ultrasonic washing apparatus according to one embodiment of the present invention, which is shown in accompanying drawings:

DETAILED DESCRIPTION OF THE PREFERRED EMBODIMENTS

Figure 1:
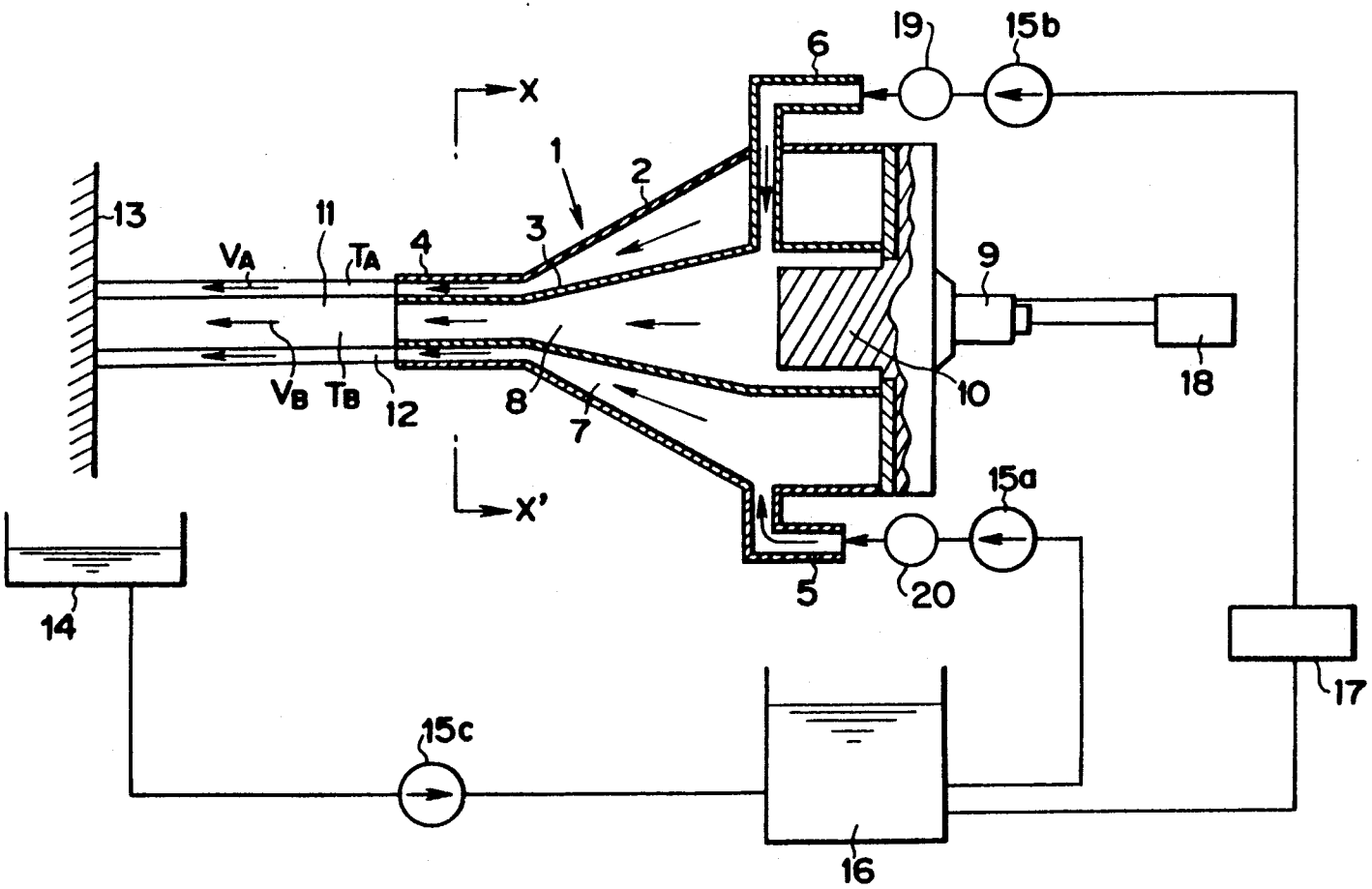
FIG. 1 is a longitudinal direction of spray type ultrasonic washing apparatus.

As shown in FIG. 1, a spray type ultrasonic washing apparatus comprises a nozzle assembly 1 and a vibrating element 9.

The nozzle assembly 1 is composed of an outer nozzle 2 and an inner nozzle 3. The inner nozzle 3 delimits a passage 8 through which deaerated medium is made to flow before being sprayed. A passage 7 through which nondeaerated medium is made to flow, is formed between the outer and inner nozzles 2 and 3. The nozzle assembly 1 is tapered towards the nozzle tip 4.

The outer nozzle 2 is provided with an inlet 5 for nondeaerated medium whereas the inner nozzle 3 is provided with an inlet 6 for deaerated medium. A vibrating element 9 has a vibrating piece 10 integrally connected thereto. The vibrating piece 10 is attached to the rear end of the nozzle assembly 1.

A vessel 16 contains washing liquid, which is nondeaerated medium. The vessel 16 is connected to the inlet 5 of the nozzle assembly 1 via a pump 15*a*. Also, the vessel 16 is connected to the inlet 6 of the nozzle assembly 1 via deaerating means 17 and a pump 15*b*. Thus, nondeaerated washing liquid 12 is supplied to the inlet 5 of the nozzle assembly 1, and deaerated washing liquid 11 is supplied to the inlet 6 of the nozzle assembly 1.

Deaerating means 17 may be so constructed that liquid may be boiled and deaerated.

Nondeaerated washing liquid 12 is made to flow to the nozzle tip 4 through the passage 7 whereas deaerated washing liquid 11 is made to flow to the nozzle tip 4 through the passage 8.

Figure 2:
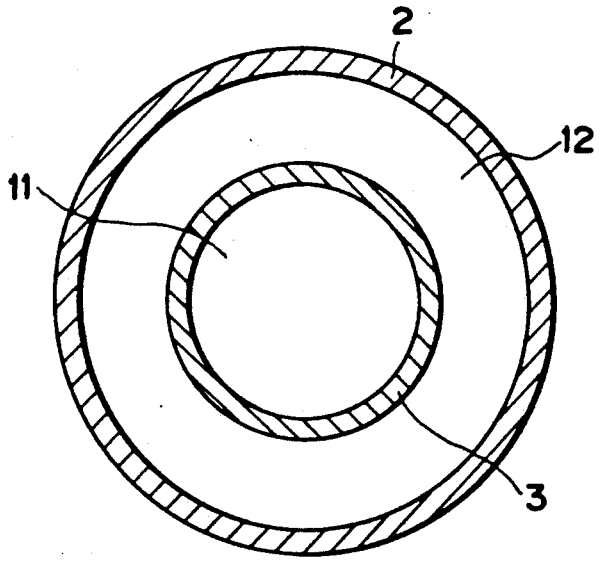
FIG. 2 is a cross section taken along the line X—X' in FIG. 1.

As shown in FIG. 2 deaerated washing liquid 11 is encircled by nondeaerated washing liquid 12, and the deaerated-and-nondeaerated washing liquid is sprayed to a work to be washed 13.

A cooling device 19 cools the deaerated washing liquid 11 and a heating device 20 heats the nondeaerated washing liquid 12 so that the temperature $T_A$ of the nondeaerated washing liquid is set higher than the temperature $T_B$ of the deaerated washing liquid. Also, pumps 15*a* and 15*b* pump the nondeaerated and deaerated washing liquid, respectively so that the flow rate $V_A$ of the nondeaerated washing liquid is set much higher than the flow rate $V_B$ of the deaerated washing liquid.

At the time of spraying the vibrating element 9 is connected to a power supply 18, thereby putting its vibrating piece 10 in operation. Then ultrasonic radiation is radiated through the deaerated washing liquid 11 in the inner passage 8 of the nozzle assembly 1. Cavitation is formed, and the work is washed efficiently.

After washing the work 13 the washing liquid is collected in a vessel 14, which is placed below the work 13. In the vessel deaerated washing liquid and aerated washing liquid are mixed together, and additionally air is mixed. Thus, nondeaerated washing liquid results, and it is supplied to the vessel 16 via a pump 15*c*.

As described above, a spray type ultrasonic washing apparatus according to the present invention uses a coaxial nozzle structure 1 which is composed of inner and outer hollow frustums 3 and 2. These frustums are designed to supply deaerated washing liquid in the annular passage formed by the outer and inner frustums and nondeaerated washing liquid in the inner hollow frustum, thus permitting deaerated washing liquid to be enclosed by nondeaerated washing liquid in spraying against work to be washed, and isolating deaerated washing liquid from the surrounding atmosphere to prevent invasion of air into the deaerated washing liquid on the way to the work. Thus, cavitation can be formed effectively in the deaerated washing liquid, and washing can be performed at an increased efficiency.

In addition, the temperature of nondeaerated washing liquid is set to be higher than that of deaerated washing liquid. This temperature difference provides a barrier to prevent invasion of air from the surrounding nondeaerated washing liquid to the deaerated washing liquid even if air enters the enclosing washing liquid from the surrounding atmosphere. This assures the effective formation of cavitation in the deaerated washing liquid by preventing invasion of air into the deaerated washing liquid.

The flow rate of deaerated washing liquid 11 is set to be much lower than that of nondeaerated washing liquid 12. This is advantageous to the spraying operation of deaerated and nondeaerated washing liquid in combination.

I claim:

1. A spray type ultrasonic washing apparatus for generating cavitation at an interface between a surface of an object being washed by said ultrasonic washing apparatus and a degassed fluid medium by inducing ultrasonic vibration in said degassed fluid medium, comprising:

a fluid nozzle assembly, comprising:

an inner first nozzle for discharging said degassed fluid medium toward said surface of said object to form a first fluid jet comprising said degassed fluid medium; and an outer second nozzle arranged coaxially about said inner first nozzle for discharging a gassed fluid medium comprising a gas therein to form a second fluid jet annually surrounding said first fluid jet to isolate said first fluid jet from a surrounding atmosphere; and means for generating ultrasonic vibration in said degassed fluid medium to cause said first fluid jet to generate said cavitation at said surface of said object.

2. A spray type ultrasonic washing apparatus as in claim 1, further comprising:

means for temporarily storing a washing fluid medium;

means for supplying said degassed fluid medium to said inner first nozzle, said supplying means comprising:

means for degassing a first portion of said washing fluid medium stored in said storing means to create said degassed fluid medium; and first means for pumping said degassed fluid medium to said inner first nozzle; and second means for pumping a second portion of said washing fluid medium stored in said stored means as said gassed fluid medium to said outer second nozzle.

3. A spray type ultrasonic washing apparatus as in claim 2, wherein said first and second pumping means pump said degassed fluid medium and said gassed fluid medium to said first nozzle and said second nozzle, respectively, at independent first and second fluid flow rates, respectively.

4. A spray type ultrasonic washing apparatus as in claim 3, wherein said first and second fluid jets are formed in accordance with said first and second fluid flow rates, respectively, and said second fluid flow rate is larger than said first flow rate.

5. A spray type ultrasonic washing apparatus as in claim 1, further comprising means for cooling said degassed fluid medium to a first temperature and means for heating said gassed fluid medium to a second temperature, said second temperature being higher than said first temperature.

* * * * *